US011384461B2

(12) United States Patent
Kambara et al.

(10) Patent No.: US 11,384,461 B2
(45) Date of Patent: Jul. 12, 2022

(54) SEWING MACHINE

(71) Applicant: JANOME SEWING MACHINE CO., LTD., Tokyo (JP)

(72) Inventors: Yumiko Kambara, Tokyo (JP); Yoshitaka Bamba, Tokyo (JP); Jun Mafune, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 65 days.

(21) Appl. No.: 16/951,643

(22) Filed: Nov. 18, 2020

(65) Prior Publication Data

US 2021/0246587 A1 Aug. 12, 2021

(30) Foreign Application Priority Data

Feb. 7, 2020 (JP) ..... JP2020-019495

(51) Int. Cl.
*D05B 37/08* (2006.01)
*D05B 73/12* (2006.01)

(52) U.S. Cl.
CPC ..... *D05B 37/08* (2013.01); *D05B 73/12* (2013.01)

(58) Field of Classification Search
CPC ..... D05B 73/12; D05B 37/063; D05B 37/08
See application file for complete search history.

(56) References Cited

U.S. PATENT DOCUMENTS 3,765,350 A * 10/1973 Sztari ..... D05B 37/063 112/122
9,303,345 B2 4/2016 Hasegawa et al.
2010/0050915 A1* 3/2010 Konig ..... D05C 7/04 112/89
2014/0290547 A1* 10/2014 Hasegawa ..... D05B 19/14 112/102.5
2014/0290550 A1* 10/2014 Hasegawa ..... D05B 37/08 112/470.05

FOREIGN PATENT DOCUMENTS

JP 2014-195491 A 10/2014

* cited by examiner

*Primary Examiner* — Nathan E Durham
(74) *Attorney, Agent, or Firm* — Nakanishi IP Associates, LLC

(57) ABSTRACT

In a sewing machine, a plurality of needle plate holes are formed in a needle plate. The needle plate holes are arranged at positions respectively corresponding to a plurality of blade-side rotation positions of a cutwork blade. In this manner, the needle plate hole is formed in a shape corresponding to a shape of a blade portion, and a direction of the needle plate hole can match a direction of the blade portion that is arranged above to face the needle plate hole. Specifically, a linear hole-side cutting surface corresponding to a blade-side cutting surface of the blade portion is formed in the needle plate hole, and the blade-side cutting surface and the hole-side cutting surface can be arranged to face each other in a direction orthogonal to both the surfaces in a plan view.

6 Claims, 8 Drawing Sheets

SEWING MACHINE

CROSS REFERENCE TO RELATED APPLICATION

This application claims priority to Japanese Patent Application No. 2020-019495 filed on Feb. 7, 2020, the entire content of which is incorporated by reference.

BACKGROUND OF THE INVENTION

Field of the Invention

The invention relates to a sewing machine.

Background Art

JP-A-2014-195491 discloses a sewing machine that can form a patent or the like on a cutting target object (cloth) by cutting the cutting target object. Specifically, a cutting needle rotation device is provided on a lower end portion of a needle bar, a cutting needle (cutwork blade) of the cutting needle rotation device is arranged coaxially with the needle bar, and is configured to be rotatable around the axis of the needle bar. Further, a needle plate is provided below the cutting needle rotation device, and a needle plate hole is formed in the needle plate. The cutting needle is lowered together with the needle bar so that a blade portion of the cutting needle is inserted into the needle plate hole, and thereby the cutting target object is cut by the blade portion and the needle plate hole.

SUMMARY OF THE INVENTION

However, in the sewing machine in JP-A-2014-195491, there is room for improvement in the following points. That is, in the above-described sewing machine, since the cutting needle is rotated around the axis of the needle bar, the direction of the cutting needle is changed according to the rotation position of the cutting needle. In JP-A-2014-195491, the shape of the needle plate hole is not particularly mentioned, but generally, the needle plate hole is formed in a circular shape in order to cope with the change of the direction of the cutting needle. Therefore, when the cutting target object is cut, the cutting target object may be torn off, and the cut portion may be formed on a rough surface. In this manner, in the above-described sewing machine, there is room for improvement in improving the finish of the cut portion.

An object of the invention is to provide a sewing machine which can improving the finish of the cut portion in consideration of the above circumstances.

One or more embodiments of the invention are a sewing machine including a rotation mechanism configured to include a base attached to a lower end portion of a needle bar that is moved up and down, and a rotation body connected to the base to be rotatable around an axis of the needle bar; a cutwork blade which is provided on the rotation body, and extends downward from the rotation body; and a needle plate which is provided below the rotation mechanism, and has a needle plate hole for cutting a cutting target object in cooperation with a blade portion of the cutwork blade when the blade portion is inserted into the needle plate hole, in which the blade portion is inserted into the needle plate hole in a state where a direction of the needle plate hole matches the blade portion of the cutwork blade.

One or more embodiments of the invention are the sewing machine in which the rotation body is locked at every predetermined rotation angle by the lock mechanism, the cutwork blade is arranged at a position apart from an axis line of the needle bar, and a plurality of the needle plate holes are formed around the axis line of the needle bar at the same angle as the predetermined angle of the lock mechanism, on a reference circle having, as a radius, the same distance as a distance between the axis line of the needle bar and the cutwork blade.

One or more embodiments of the invention are the sewing machine in which the rotation body is locked at every predetermined rotation angle by the lock mechanism, and the needle plate is configured to include a needle plate body fixed to the sewing machine body, and a rotary needle plate which is connected to the needle plate body to be rotatable around the axis of the needle bar, and is able to be locked at every angle that is the same as the predetermined angle of the lock mechanism, and in which the needle plate hole is formed.

One or more embodiments of the invention are the sewing machine in which the cutwork blade is arranged coaxially with the needle bar.

One or more embodiments of the invention are the sewing machine in which the cutwork blade and the needle plate hole are arranged at positions apart from the axis line of the needle bar by the same distance.

One or more embodiments of the invention are the sewing machine in which the blade portion has a blade-side cutting surface that is linearly formed when seen from an axial direction of the needle bar, and the needle plate hole has a hole-side cutting surface that is formed in a flat surface shape, corresponding to the blade-side cutting surface.

According to the sewing machine having the above-described configuration, the finish of the cut portion can be improved.

DETAILED DESCRIPTION OF THE INVENTION

First Embodiment

Figure 1:
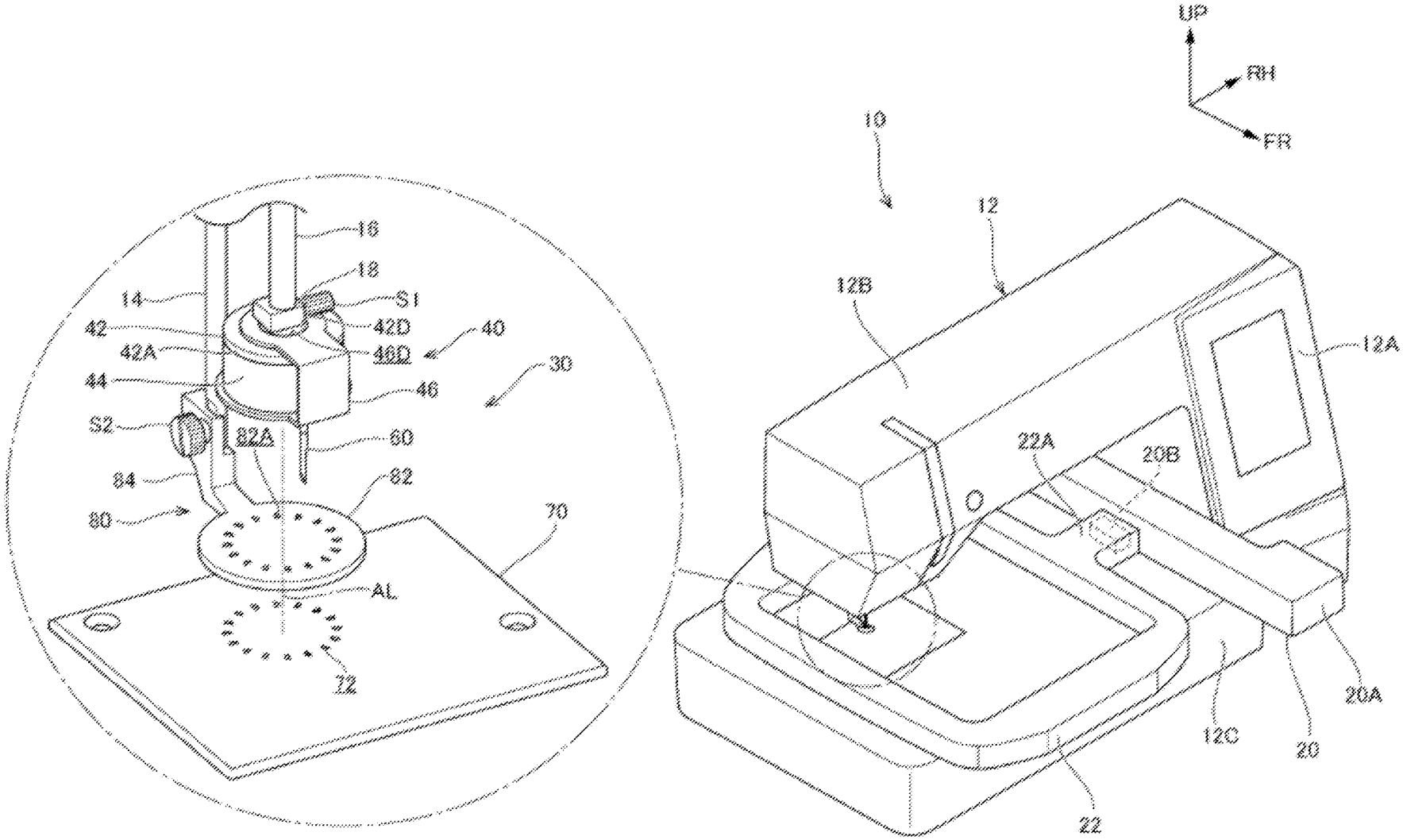
FIG. 1 is a perspective view illustrating a sewing machine according to a first embodiment, which is seen diagonally from the front left.

Hereinafter, a sewing machine 10 according to a first embodiment will be described using FIGS. 1 to 4. Arrows UP, FR, and RH appropriately illustrated in the drawings indicate the upper side, the front side, and the right side (one side in a width direction) of the sewing machine 10, respectively. Hereinafter, in a case where description is made using the up-down direction, the front-rear direction, and the left-right direction, those directions indicate the up and down, the front and rear, and the left and right of the sewing machine 10.

As illustrated in FIG. 1, the sewing machine 10 has a sewing machine body 12, and the sewing machine body 12 is formed in a substantially U shape open leftward in a front view seen from the front side. Specifically, the sewing machine body 12 is configured to include a pillar portion 12A that constitutes a right end portion of the sewing machine body 12 and extends in the up-down direction, an arm portion 12B that extends to the left side from the upper end portion of the pillar portion 12A, and a bed portion 12C that extends to the left side from the lower end portion of the pillar portion 12A.

A presser bar 14 that extends in the up-down direction is provided inside a left end portion of the arm portion 12B, and a lower end portion of the presser bar 14 protrudes downward from the arm portion 12B. The presser bar 14 is supported by an operation lever (not illustrated), and is configured to be moved in the up-down direction by operating the operation lever.

Further, a substantially columnar needle bar 16 of which the axial direction is the up-down direction is provided in front of the presser bar 14. The upper end portion of the needle bar 16 is provided inside the arm portion 12B, and the lower end portion of the needle bar protrudes downward from the arm portion 12B. The needle bar 16 is connected to a needle bar drive mechanism (not illustrated), and the needle bar 16 is moved in the up-down direction in a reciprocating manner by the needle bar drive mechanism during the operation of the sewing machine 10. Further, a needle bar fixing portion 18 for fixing a base 42, which will be described later, is provided on the lower end portion of the needle bar 16. A fixing hole (not illustrated) is formed in the needle bar fixing portion 18, and the fixing hole is open downward, and is formed to have a substantially D-shaped cross section.

The sewing machine 10 is configured as a sewing machine that can perform cutting on a cutting target object 90 (refer to FIG. 4) such as cloth. Specifically, the sewing machine 10 has an embroidery frame drive device 20, an embroidery frame 22, a needle plate 70, a presser 80, and a cutwork mechanism 30 which are used during cutting. Hereinafter, each configuration of the sewing machine 10 used during cutting will be described.

Regarding Embroidery Frame Drive Device 20

The embroidery frame drive device 20 is detachably mounted on the bed portion 12C of the sewing machine body 12. The embroidery frame drive device 20 is configured to include a drive arm 20A and a carriage 20B. The drive arm 20A is formed in a substantially rectangular parallelepiped shape extending in the front-rear direction, and is configured to be movable in the left-right direction, on a side above the bed portion 12C. The carriage 20B is provided on the drive arm 20A so as to be movable in the front-rear direction. The drive arm 20A and the carriage 20B are configured to be moved by a drive unit (not illustrated) of the embroidery frame drive device 20.

Regarding Embroidery Frame 22

The embroidery frame 22 is formed in a substantially rectangular frame shape. An embroidery frame fixing portion 22A protruding rightward is formed on the right outer circumferential portion of the embroidery frame 22, and the embroidery frame fixing portion 22A is fixed to the carriage 20B of the embroidery frame drive device 20. In this manner, the embroidery frame 22 is configured to be moved in the front-rear and left-right directions, on a side below the needle bar 16, by driving the embroidery frame drive device 20. In addition, the embroidery frame 22 is configured by two members, and the embroidery frame 22 is configured to vertically sandwich the cutting target object 90. In this manner, the cutting target object 90 is configured to be movable in the front-rear and left-right directions together with the embroidery frame 22, on a side below the needle bar 16 and above the bed portion 12C.

Regarding Cutwork Mechanism 30

Figure 2:
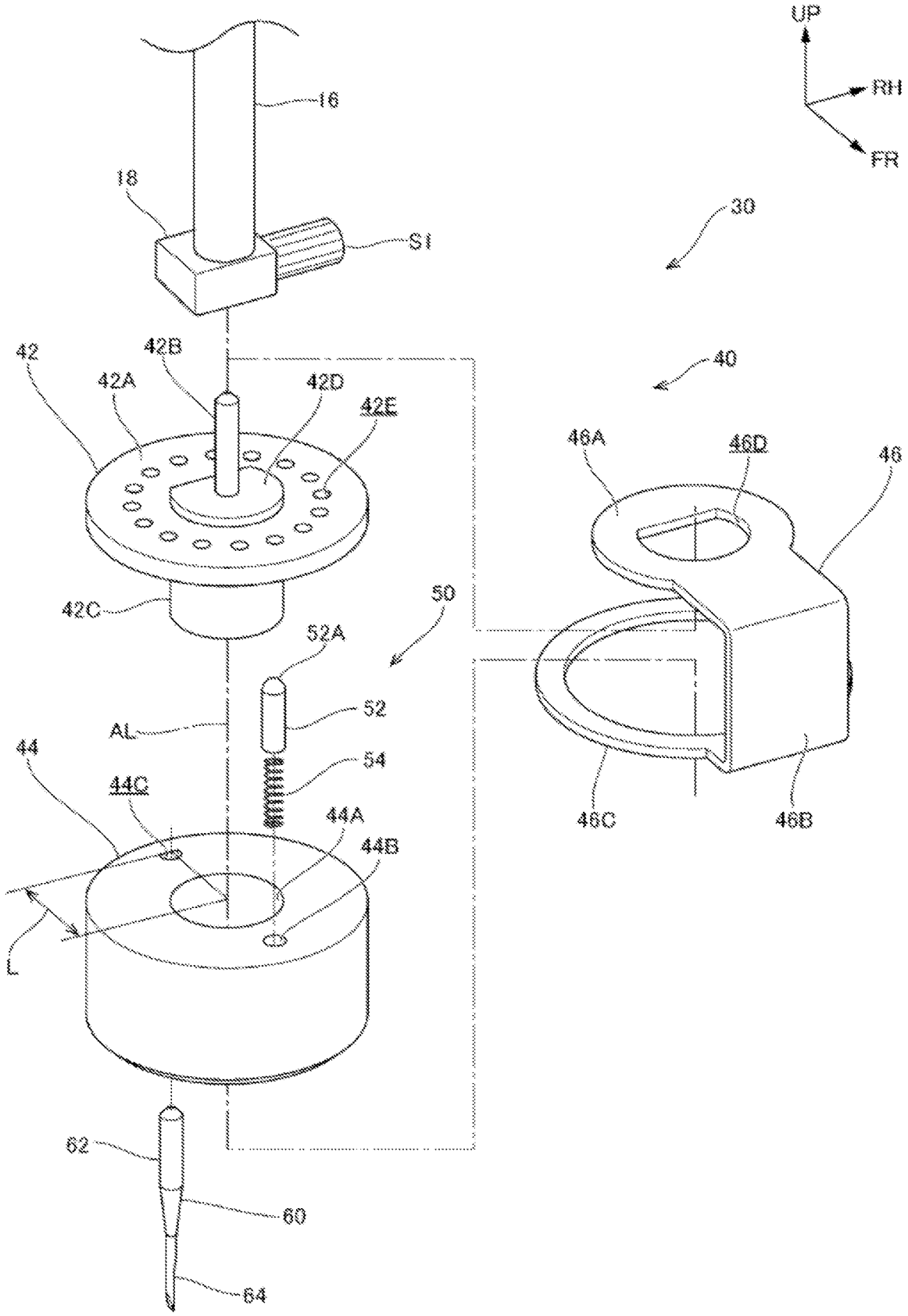
FIG. 2 is an exploded perspective view in which a cutwork mechanism illustrated in FIG. 1 is exploded.

As illustrated in FIGS. 1 and 2, the cutwork mechanism 30 is configured to include a rotation mechanism 40, a lock mechanism 50, and a cutwork blade 60.

Regarding Rotation Mechanism 40

The rotation mechanism 40 has the base 42, a rotation body 44, and a bracket 46.

The base 42 has a base plate 42A, and the base plate 42A is formed in a substantially disk shape of which the plate thickness direction is the up-down direction. A base fixing shaft 42B protruding upward is formed at a central portion of the base plate 42A, and the base fixing shaft 42B is formed in a substantially D shape in a plan view. The base fixing shaft 42B is mounted to the fixing hole of the needle bar fixing portion 18 from below, and is fixed to the needle bar fixing portion 18 by a fixing screw S1. In this manner, the base 42 is connected to the needle bar 16 so as not to be relatively movable.

The base 42 has a connection pillar 42C for connecting the rotation body 44 which will be described later. The connection pillar 42C is formed in a substantially columnar shape of which the axial direction is the up-down direction, extends downward from the base plate 42A, and is arranged coaxially with the needle bar 16.

A fitting portion 42D protruding upward is formed at a substantially central portion on the upper surface of the base plate 42A. The fitting portion 42D is formed in a substantially D shape in a plan view.

Further, a plurality of (16 in the embodiment) circular lock holes 42E are formed to penetrate the base plate 42A, on the outer side of the connection pillar 42C and the fitting portion 42D in a radial direction. The lock holes 42E are arranged on an imaginary circle centering on an axis line AL of the needle bar 16, and are arranged at equal intervals (every 22.5 degrees) around the axis line AL. The lock holes 42E constitute a part of the lock mechanism 50 which will be described later.

The rotation body 44 is formed in a substantially bottomed cylindrical shape which is open upward. Specifically, a connection recess 44A open upward is formed at the central portion of the rotation body 44, and the connection recess 44A is formed in a circular shape in a plan view. Then, the connection pillar 42C of the base 42 is inserted into the connection recess 44A from above, and the rotation body 44 is rotatably supported by the connection pillar 42C. That is, the rotation body 44 is arranged coaxially with the needle bar 16, and is connected to the base 42 so as to be rotatable around the axis line AL.

An accommodation recess 44B for accommodating a lock pin 52, which will be described later, is formed on the upper surface of the rotation body 44. The accommodation recess 44B is formed in a recess shape open upward, and is formed in a circular shape in a plan view. Further, in a plan view, the distance from the axis line AL to the accommodation recess 44B and the distance from the axis line AL to the lock hole 42E are the same. In this manner, the accommodation recess 44B and the lock hole 42E are configured to be arranged to face each other in the up-down direction, at a specific rotation position of the rotation body 44. The position of the rotation body 44 where the accommodation recess 44B and the lock hole 42E are arranged to face each other in the up-down direction is referred to as a rotation body lock position. That is, in the embodiment, 16 rotation body lock positions of the rotation body 44 are set around the axis line AL.

Further, a fixing hole 44C for fixing the cutwork blade 60, which will be described later, is formed to penetrate the rotation body 44 in the up-down direction. The fixing hole 44C is formed in a substantially D shape in a plan view, and is arranged 180 degrees apart from the accommodation recess 44B in the circumferential direction (rotation direction) of the rotation body 44.

The bracket 46 is formed in a substantially U-shaped plate shape open rearward, in a side view seen from the left-right direction. Specifically, the bracket 46 is configured to include an upper wall 46A, a front wall 46B extending downward from the front end portion of the upper wall 46A, and a lower wall 46C extending rearward from the lower end portion of the front wall 46B.

The upper wall 46A is arranged adjacent to the upper side of the base plate 42A of the base 42, and the lower wall 46C is arranged adjacent to the lower side of the rotation body 44 so that the base 42 and the rotation body are sandwiched by the bracket 46 in the up-down direction. In this manner, the downward movement of the rotation body 44 is restricted by the bracket 46.

A fitting hole 46D is formed to penetrate the upper wall 46A. The fitting hole 46D is formed in a substantially D shape in a plan view, corresponding to the fitting portion 42D of the base 42. The fitting portion 42D is fitted into the fitting hole 46D. In this manner, the rotation of the bracket 46 around the axis line AL relative to the base 42 is restricted.

The lower wall 46C is formed in a substantially annular plate shape, and is arranged coaxially with the needle bar 16. The outer diameter of the lower wall 46C is set to be greater than the outer diameter of the rotation body 44. Further, the inner diameter of the lower wall 46C is set to be greater than a distance L from the axis line AL to the fixing hole 44C. That is, the fixing hole 44C is arranged inward of the lower wall 46C when seen from below.

Regarding Lock Mechanism 50

The lock mechanism 50 is configured as a mechanism that locks (prevents) the rotation of the rotation body 44. The lock mechanism 50 is configured to include the lock holes 42E formed on the base 42, the lock pin 52, and an urging spring 54.

The lock pin 52 is formed in a substantially columnar shape of which the axial direction is the up-down direction. The lock pin 52 is inserted into the accommodation recess 44B of the rotation body 44 so as to be relatively movable in the up-down direction. The upper end portion of the lock pin 52 is configured as an engaging portion 52A, and the engaging portion 52A is formed in a hemispherical shape that is convex upward. Further, the diameter of the lock pin 52 is set to be greater than the diameter of the lock hole 42E of the base 42.

The urging spring 54 is configured as a compression coil spring. The urging spring 54 is accommodated in the accommodation recess 44B together with the lock pin 52 in a state of being compressed and deformed. Specifically, the urging spring 54 is arranged below the lock pin 52, the lower end portion of the urging spring 54 is locked to the bottom surface of the accommodation recess 44B, and the upper end portion of the urging spring 54 is locked to the lower surface of the lock pin 52. In this manner, the lock pin 52 is urged upward by the urging spring 54.

At the rotation body lock position of the rotation body 44, the top of the engaging portion 52A of the lock pin 52 is arranged in the lock hole 42E, and the engaging portion 52A is in contact with the edge portion of the lock hole 42E, so that the lock pin 52 and the lock hole 42E are engaged with each other. In this manner, the rotation of the rotation body 44 is locked (prevented).

Further, at the rotation body lock position of the rotation body 44, the lock state of the rotation body 44 by the lock mechanism 50 is released by applying rotational force equal to or greater than a predetermined value to the rotation body 44. That is, by applying the rotational force equal to or greater than the predetermined value to the rotation body 44, the lock pin is moved downward against the urging force of the urging spring 54, and thereby the engaged state between the lock pin 52 and the lock hole 42E is released. Then, the lock pin 52 is engaged with the lock hole 42E again by relatively rotating the rotation body 44 to the next rotation body lock position, and thereby the rotation body returns to the lock state by the lock mechanism 50. That is, the rotation body 44 is configured to be locked at every predetermined rotation angle (22.5 degrees in the embodiment) by the lock mechanism 50.

Regarding Cutwork Blade 60

Figure 3:
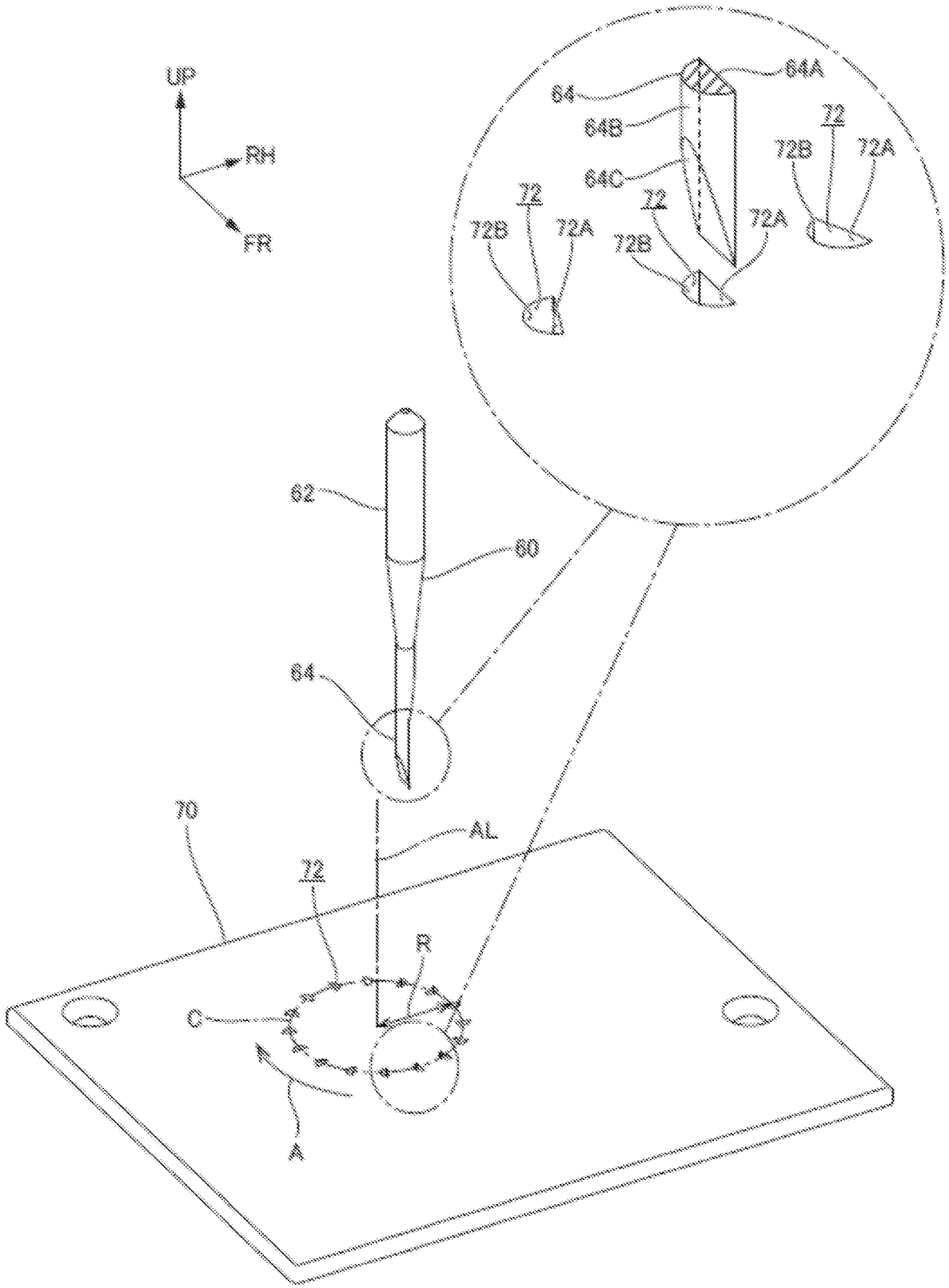
FIG. 3 is a perspective view illustrating a needle plate and a cutwork blade illustrated in FIG. 1 in an enlarged manner.

As illustrated in FIG. 3, the cutwork blade 60 is formed in a substantially bar shape of which the axial direction is the up-down direction. The upper portion of the cutwork blade 60 is configured as a blade-side fixing portion 62, and the blade-side fixing portion 62 is formed in a substantially D shape corresponding to the fixing hole 44C of the rotation body 44 in a plan view. The blade-side fixing portion 62 is fitted into the fixing hole 44C of the rotation body 44 from below, so that the cutwork blade 60 is fixed to the rotation body 44. In this manner, in a state where the rotation of the cutwork blade 60 relative to the rotation body 44 is restricted, the cutwork blade 60 is arranged at a position apart (eccentric) from the axis line AL by the distance L in a plan view. That is, the cutwork blade 60 is configured to be rotated around the axis line AL at a position eccentric with respect to the axis line AL by the rotating the rotation body 44 around the axis line AL. In the following description, the position of the cutwork blade 60 at the rotation body lock position of the rotation body 44 is referred to as a blade-side rotation position. In this manner, in the cutwork mechanism 30, a plurality of (16 in the embodiment) blade-side rotation positions are set around the axis line AL, and the cutwork blade 60 is configured to be held at a specific blade-side rotation position by the lock mechanism 50.

The lower end portion of the cutwork blade 60 is configured as a blade portion 64 for cutting the cutting target object 90. The blade portion 64 is formed in a substantially D shape when seen from below. Specifically, the blade portion 64 is configured to include a blade-side cutting surface 64A extending linearly in the radial direction of the rotation body 44 in a plan sectional view, and a blade-side curved surface 64B which is curved in a substantially arc shape to be convex to one side around the axis line AL (which is a direction of an arrow A in FIG. 3, and is one side of the rotation direction of the rotation body 44) in a plan sectional view. Further, in the blade portion 64, the blade-side cutting surface 64A mainly has a function of cutting the cutting target object 90. That is, the cutwork blade 60 is formed in a non-circular shape including at least a linear portion constituting the blade-side cutting surface 64A in a plan sectional view.

Further, an inclined surface 64C is formed on the lower end portion of the blade-side curved surface 64B of the blade portion 64. The lower end of the inclined surface 64C matches the lower end of the blade-side cutting surface 64A, the inclined surface 64C is inclined to the one side in the rotation direction of the rotation body 44 as going upward when seen from the radial direction of the rotation body 44.

Regarding Needle Plate 70

As illustrated in FIGS. 1 and 3, the needle plate 70 is formed in a substantially rectangular plate shape of which the plate thickness direction is the up-down direction. The needle plate 70 is detachably fixed to the upper portion of the bed portion 12C of the sewing machine body 12, and is arranged below the cutwork mechanism 30. The cutting target object 90 sandwiched by the embroidery frame 22 is placed above the needle plate 70 (refer to FIG. 4).

A plurality of (16 in the embodiment) needle plate holes 72 are formed to penetrate the needle plate 70. The plurality of needle plate holes 72 are arranged on a reference circle C which is around the axis line AL of the needle bar 16 and has a radius R, in a plan view. Further, the needle plate holes 72 are arranged at equal intervals (every 22.5 degrees) around the axis line AL (rotation direction of the rotation body 44). That is, the plurality of needle plate holes 72 are arranged along the rotation direction of the cutwork blade (rotation body 44). The distance L from the axis line AL to the cutwork blade 60 and the distance from the axis line AL to the needle plate hole 72 (that is, the radius R of the reference circle C) are the same.

Further, the plurality of needle plate holes 72 are arranged at positions corresponding to the blade-side rotation positions of the cutwork blade 60. In other words, the positions of the plurality of needle plate holes 72 are set such that the cutwork blade 60 held at the blade-side rotation position is arranged to face any of the needle plate holes 72 of the needle plate 70 in the up-down direction.

In addition, the needle plate hole 72 is formed in a shape corresponding to the blade portion 64 of the cutwork blade 60. Specifically, the needle plate hole 72 is formed in a substantially D shape similar to that of the blade portion 64 in a plan view, and the outer shape of the needle plate hole 72 is set to be slightly greater than the outer shape of the blade portion 64. More specifically, the needle plate hole 72 is configured to include a hole-side cutting surface 72A which corresponds to the blade-side cutting surface 64A of the blade portion and extends linearly in the radial direction of the rotation body 44 in a plan view, and a hole-side curved surface 72B which corresponds to the blade-side curved surface 64B of the blade portion 64 and is curved in a substantially arc shape to be convex to one side (direction of the arrow A in FIG. 3) of the rotation direction of the rotation body 44 in a plan view. In this manner, the directions the needle plate hole 72 and the blade portion 64 which are arranged to face each other in the up-down direction match each other in a plan view.

When the cutwork blade 60 is lowered together with the needle bar 16, the blade portion 64 of the cutwork blade 60 is inserted into the needle plate hole 72 so that the cutting target object 90 is cut. Specifically, when the blade portion 64 is inserted into the needle plate hole 72, the blade-side cutting surface 64A of the blade portion 64 and the hole-side cutting surface 72A of the needle plate hole 72 are arranged to face each other in a state where there is almost no gap in the rotation direction of the rotation body 44. In this manner, the cutting target object 90 is sheared by the blade-side cutting surface 64A of the blade portion 64 and the hole-side cutting surface 72A of the needle plate hole 72 so that the cutting target object 90 is cut.

It is sufficient that the needle plate hole 72 is formed in a non-circular shape including at least the hole-side cutting surface 72A corresponding to the blade portion 64 of the cutwork blade 60 in a plan view. Therefore, the expression "the blade portion is inserted into the needle plate hole in a state where the direction of the needle plate hole matches the blade portion of the cutwork blade" in the invention refers to that the blade portion 64 is inserted into the needle plate hole 72 such that the blade-side cutting surface 64A of the blade portion 64 and the hole-side cutting surface 72A of the needle plate hole 72 face each other.

Regarding Presser 80

Figure 4:
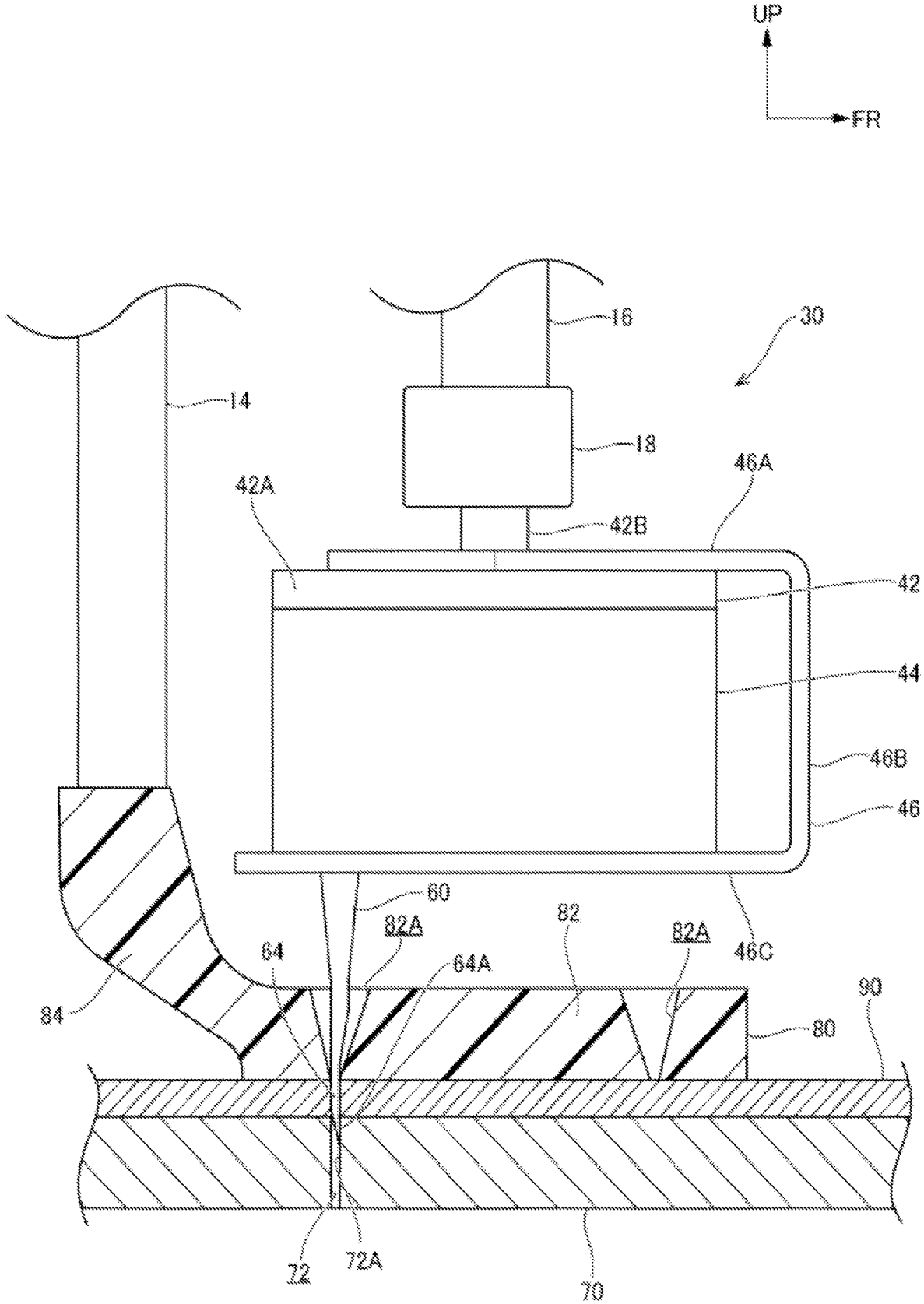
FIG. 4 is a vertical sectional view schematically illustrating a state in which a cutting target object is cut by the cutwork blade and a needle plate hole of the needle plate illustrated in FIG. 1.

As illustrated in FIGS. 1 and 4, the presser 80 is configured to include a presser plate portion 82, and a presser fixing portion 84. The presser plate portion 82 is formed in a substantially disk shape of which the plate thickness direction is the up-down direction. The presser fixing portion 84 is formed in a substantially L-shaped block shape when seen from the left side, and the lower end portion of the presser fixing portion 84 is connected to the rear end portion of the presser plate portion 82. The upper end portion of the presser fixing portion 84 is fixed to the lower end portion of the presser bar 14 by a fixing screw S2. The presser 80 is moved downward together with the presser bar 14 by operating the operation lever (not illustrated) so as to press the cutting target object 90 from above.

Further, a plurality of (16 in the embodiment) insertion holes 82A are formed to penetrate the presser plate portion 82, at positions corresponding to the needle plate holes 72 of the needle plate 70. The insertion hole 82A is formed to have a substantially D-shaped cross section similar to that of the needle plate hole 72. The inner circumferential surface of the insertion hole 82A is inclined inward of the insertion hole 82A as going downward. That is, the size of the outer shape of the insertion hole 82A is set to be decreased as going downward. Further, the outer shape of the lower end of the insertion hole 82A is set to be greater than the outer shape of the needle plate hole 72. When the needle bar 16 is lowered, the blade portion 64 of the cutwork blade 60 is inserted through the insertion hole 82A while being guided by the inner circumferential surface of the insertion hole 82A, and is inserted into the needle plate hole 72 from above (refer to FIG. 4).

Action and Effect

In the sewing machine 10 configured as described above, the base 42 is attached to the lower end portion of the needle bar 16, and the rotation body 44 is connected to the base 42 to be rotatable around the axis line AL of the needle bar 16. The rotation body 44 is provided with the cutwork blade 60, and the cutwork blade 60 extends downward from the rotation body 44 at a position eccentric from the axis line AL by the distance L. Further, at the rotation body lock position of the rotation body 44, the rotation of the rotation body 44 is restricted by the lock mechanism 50, and the cutwork blade 60 is held at any of the plurality of blade-side rotation positions.

The needle plate 70 is provided below the rotation body 44. The plurality of needle plate holes 72 into which the blade portion 64 of the cutwork blade 60 is inserted are formed in the needle plate 70, and the plurality of needle plate holes 72 are arranged along the rotation direction of the cutwork blade 60 (rotation body 44). Specifically, the plurality of needle plate holes 72 are arranged at positions respectively corresponding to the plurality of blade-side rotation positions of the cutwork blade 60. More specifically, the plurality of needle plate holes 72 are arranged directly below the cutwork blade 60 arranged at the blade-side rotation position, and the cutwork blade 60 (blade portion 64) and the needle plate hole 72 are arranged to face each other in the up-down direction. In this manner, when the needle bar 16 is lowered so that the blade portion 64 is inserted into the needle plate hole 72, the cutting target object 90 placed above the needle plate 70 is cut by the blade portion 64 and the needle plate hole 72.

Here, in the needle plate 70, the plurality of needle plate holes 72 are formed in a shape corresponding to the shape of the blade portion 64, and the direction of each of the needle plate holes 72 matches the direction of the blade portion 64 which is arranged to face the needle plate hole in the up-down direction. Specifically, the needle plate hole 72 has the hole-side cutting surface 72A corresponding to the blade-side cutting surface 64A of the blade portion 64, and the blade-side cutting surface 64A and the hole-side cutting surface 72A are formed in a flat surface shape. Further, the direction of the needle plate hole 72 is set such that the blade-side cutting surface 64A and the hole-side cutting surface 72A face each other when the blade portion 64 is inserted into the needle plate hole 72. In this manner, when the cutting target object 90 is cut by the blade portion 64 and the needle plate hole 72, the cutting target object 90 can be sheared and cut by the blade-side cutting surface 64A and the hole-side cutting surface 72A. As a result, the finish of the cut portion of the cutting target object 90 can be improved.

That is, for example, in the sewing machine described in the background art (hereinafter, this sewing machine is referred to as a sewing machine in a comparative example), the cutwork blade is arranged coaxially with the needle bar, and the cutwork blade is rotated around the axis of the needle bar at every predetermined rotation angle. Therefore, in the sewing machine of the comparative example, in a case where the cutwork blade is rotated around the axis of the needle bar at every predetermined rotation angle, the cutwork blade is rotated around the axis of the needle bar relative to the needle plate in a state where the position of the cutwork blade relative to the needle plate is not changed. That is, the direction of the blade portion with respect to the needle plate is changed in a state where the position of the blade portion of the cutwork blade relative to the needle plate is not changed.

Therefore, in the sewing machine of the comparative example, in order to prevent the interference between the blade portion and the needle plate hole when the blade portion of the cutwork blade is inserted into the needle plate hole, for example, it is necessary to form the needle plate hole in a relatively large round shape. That is, in the needle plate hole, the hole-side cutting surface having a flat surface shape which corresponds to the blade-side cutting surface of the blade portion cannot be formed. In this manner, in the sewing machine of the comparative example, the cutting target object 90 cannot be sheared to be cut by the blade portion and the needle plate hole, and thus the blade portion performs cutting by tearing off the cutting target object 90. Therefore, the cut portion of the cutting target object 90 may become a rough surface.

On the other hand, in the sewing machine 10 of the first embodiment, the cutwork blade 60 is configured to be rotatable around the axis line AL of the needle bar 16, and is arranged at a position apart from the axis line AL by the distance L. Therefore, when the cutwork blade 60 is rotated around the axis line AL, the position of the cutwork blade 60 relative to the needle plate 70 is changed, and the direction of the blade portion 64 with respect to the needle plate 70 is changed. In this manner, in the sewing machine 10 of the first embodiment, by forming a plurality of the needle plate holes 72, which respectively correspond to the blade-side rotation positions of the cutwork blade 60, in the needle plate 70, the cutwork blade 60 arranged at the blade-side rotation position and the needle plate hole 72 can have a one-to-one correspondence. That is, each needle plate hole 72 has a shape corresponding to the blade portion 64, and the direction of each needle plate hole 72 can match the direction of the blade portion 64 arranged to face the needle plate hole in the up-down direction. As a result, as described above, when the cutting target object 90 is cut by the blade portion 64 and the needle plate hole 72, the cutting target object 90 can be sheared and cut by the blade-side cutting surface 64A and the hole-side cutting surface 72A. Accordingly, the finish of the cut portion of the cutting target object 90 can be improved.

The cutwork mechanism 30 has the lock mechanism 50, and the rotation body 44 is locked at every predetermined rotation angle by the lock mechanism 50. The cutwork blade 60 is provided on the rotation body 44 at a position apart from the axis line AL by the distance L. Further, the plurality of needle plate holes 72 are formed in the needle plate 70. The plurality of needle plate holes 72 are arranged on the reference circle C which is around the axis line AL and has a radius R, and the radius R and the distance L are set to be the same. In this manner, by forming, in the needle plate 70, the needle plate holes 72 of which the directions match the cutwork blade 60 held at the plurality of blade-side rotation positions eccentric with respect to the axis line AL, cutwork can be performed on the cutting target object 90.

The blade portion 64 of the cutwork blade 60 has the blade-side cutting surface 64A that is linearly formed when seen from below, and the needle plate hole 72 has the hole-side cutting surface 72A having a flat surface shape corresponding to the blade-side cutting surface 64A. Specifically, the needle plate hole 72 has the hole-side cutting surface 72A arranged to face the rotation direction of the cutwork blade 60 when the blade portion 64 is inserted into the needle plate hole 72. In this manner, as described above, when the cutting target object 90 is cut by the blade portion 64 and the needle plate hole 72, the cutting target object 90 can be sheared and cut by the blade-side cutting surface 64A and the hole-side cutting surface 72A. Accordingly, the finish of the cut portion of the cutting target object 90 can be improved.

Second Embodiment

Figure 5:
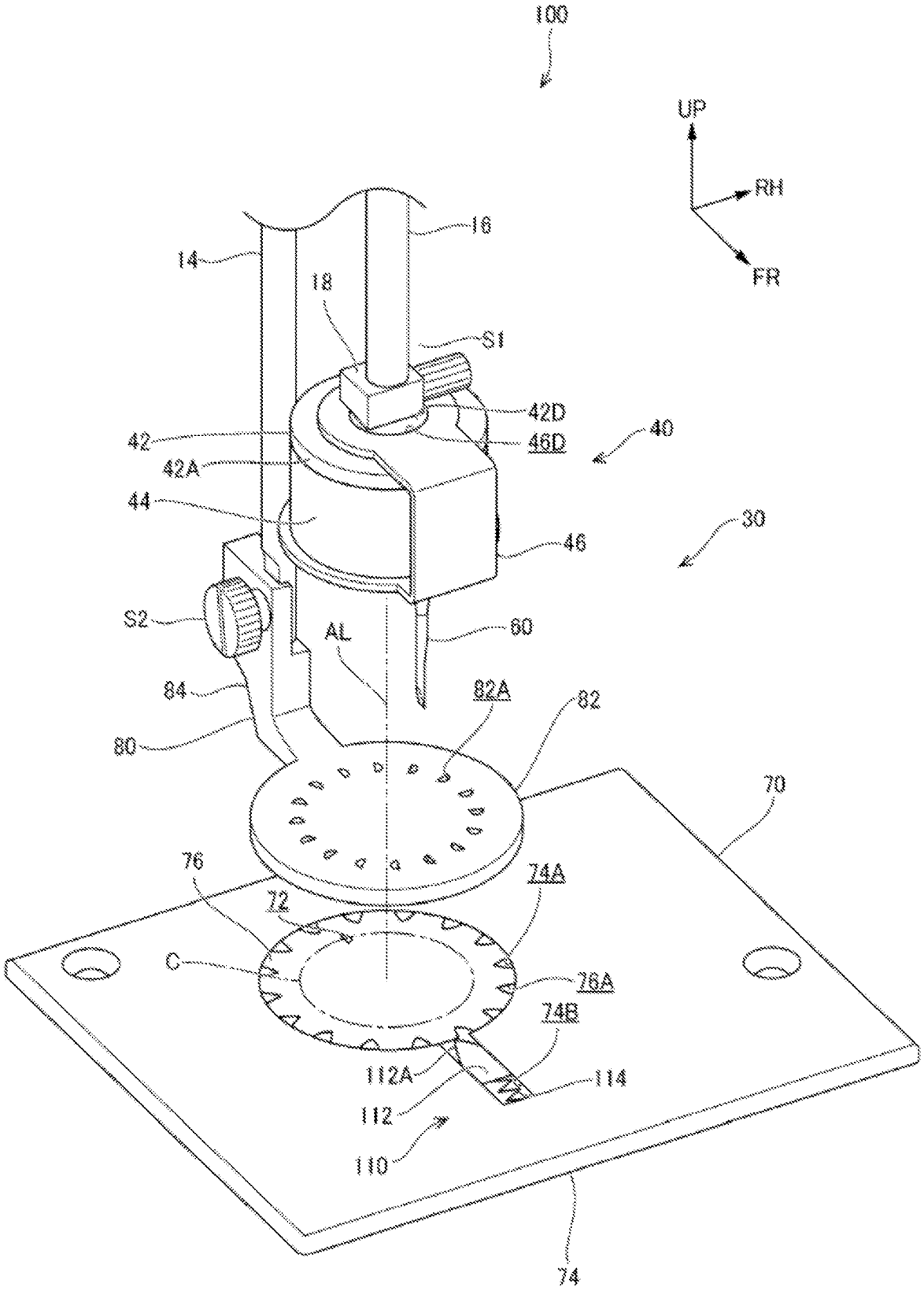
FIG. 5 is a perspective view illustrating a main part of a sewing machine according to a second embodiment, which is seen diagonally from the front left.
Figure 6:
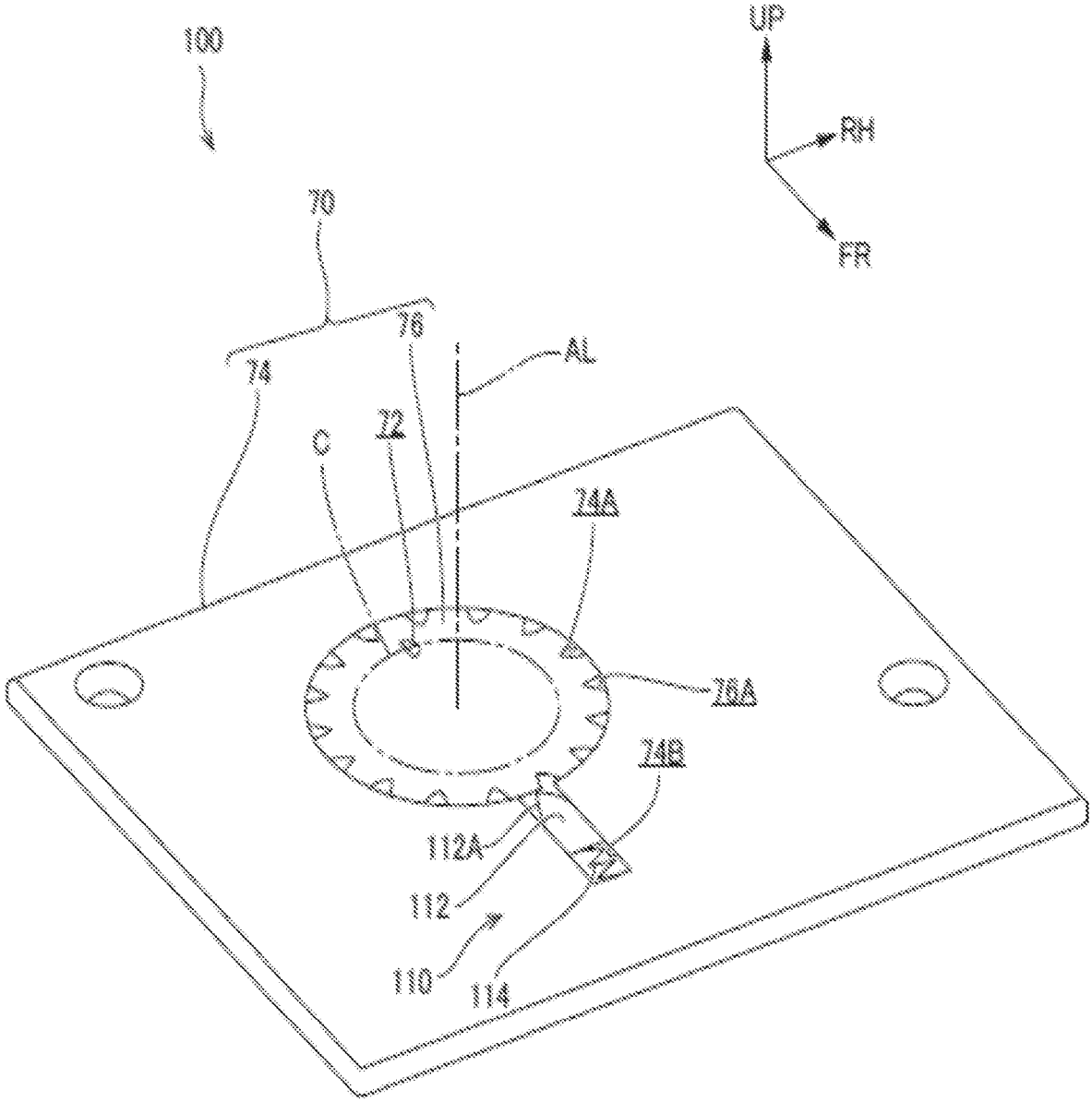
FIG. 6 is a perspective view illustrating a needle plate illustrated in FIG. 5 in an enlarged manner.

Hereinafter, a sewing machine 100 according to a second embodiment will be described using FIGS. 5 and 6. The sewing machine 100 of the second embodiment is configured similar to the sewing machine 10 of the first embodiment except the following points. In FIGS. 5 and 6, the portions configured similar to the sewing machine 10 are denoted by the same reference numerals.

That is, in the second embodiment, the needle plate 70 is configured to include a needle plate body 74, and a rotary needle plate 76. Further, a needle plate lock mechanism 110 is provided in the needle plate 70. Hereinafter, the configurations of the needle plate 70 and the needle plate lock mechanism 110 in the second embodiment will be described.

Regarding Needle Plate Body 74

The needle plate body 74 is formed in a substantially rectangular plate shape of which the plate thickness direction is the up-down direction, and is detachably fixed to the upper portion of the bed portion 12C of the sewing machine body 12, on a side below the cutwork mechanism 30. In the needle plate body 74, an exposure hole 74A for exposing the rotary needle plate 76 which will be described later is formed below the needle bar 16 to penetrate the needle plate body 74, and the exposure hole 74A is formed in a circular shape and is arranged coaxially with the needle bar 16.

Further, in the needle plate body 74, an accommodation groove 74B for accommodating a needle plate lock member 112 which will be described later is formed on the front side of the exposure hole 74A. The accommodation groove 74B extends in the front-rear direction (radial direction of the exposure hole 74A) in a plan view, and the rear end portion of the accommodation groove 74B communicates with the exposure hole 74A.

Regarding Rotary Needle Plate 76

The rotary needle plate 76 is formed in a substantially disk shape of which the plate thickness direction is the up-down direction. The rotary needle plate 76 is inserted into the exposure hole 74A of the needle plate body 74, and is rotatably supported by the exposure hole 74A. In this manner, the rotary needle plate 76 is connected to the needle plate body 74 so as to be rotatable around the axis line AL. A flange (not illustrated) protruding outward in the radial direction is formed in the outer circumferential portion of the rotary needle plate 76, and this flange is arranged adjacent to the lower side of the edge portion of the exposure hole 74A. In this manner, the upward movement of the rotary needle plate 76 is restricted. Further, the rotary needle plate 76 is urged upward by a plate spring (not illustrated) provided on the needle plate body 74. In this manner, the downward movement of the rotary needle plate 76 is restricted.

A plurality of (16 in the embodiment) lock grooves 76A are formed on the outer circumferential portion of the rotary needle plate 76. The lock groove 76A is formed in a substantially V shape open outward in the radial direction of the rotary needle plate 76, and the lock grooves 76A are arranged at equal intervals (every 22.5 degrees) in the circumferential direction of the rotary needle plate 76. The lock grooves 76A constitute a part of the needle plate lock mechanism 110 which will be described later.

One needle plate hole 72 is formed to penetrate the rotary needle plate 76, at a portion on the outer circumferential side of the rotary needle plate 76. Similar to the first embodiment, the needle plate hole 72 is formed on the reference circle C which is around the axis line AL and has a radius R. Further, similar to the first embodiment, the needle plate hole 72 is configured to include the hole-side cutting surface 72A which extends in the radial direction of the rotation body 44, and the hole-side curved surface 72B which is curved to be convex to one side of the rotation direction of the rotation body 44.

Regarding Needle Plate Lock Mechanism 110

The needle plate lock mechanism 110 is configured to include the lock grooves 76A formed in the above-described rotary needle plate 76, the needle plate lock member 112, and an urging spring 114.

The needle plate lock member 112 is formed in a substantially long plate shape of which the plate thickness direction is the up-down direction and which extends in the front-rear direction. The needle plate lock member 112 is inserted into the accommodation groove 74B of the needle plate body 74 so as to be relatively movable in the front-rear direction. A flange (not illustrated) protruding to both sides in the left-right direction is formed in the left and right outer circumferential portions of the needle plate lock member 112, and this flange is arranged adjacent to the lower side of the edge portion of the accommodation groove 74B. In this manner, the upward movement of the needle plate lock member 112 is restricted. Further, the needle plate lock member 112 is urged upward by a plate spring (not illustrated) provided on the needle plate body 74. In this manner, the flange of the needle plate lock member 112 is in contact with the lower surface of the needle plate body 74, and the needle plate lock member 112 is held by the needle plate body 74.

The rear end portion of the needle plate lock member 112 is configured as an engaging portion 112A. The engaging portion 112A is formed in a substantially V shape, which is convex rearward in a plan view, corresponding to the lock grooves 76A of the rotary needle plate 76.

The urging spring 114 is configured as a compression coil spring. The urging spring 114 is accommodated in the accommodation groove 74B together with the needle plate lock member 112 in a state of being compressed and deformed. Specifically, one end portion of the urging spring 114 is locked to the front end portion of the needle plate lock member 112, and the other end portion of the urging spring 114 is locked to the bottom portion of the accommodation groove 74B, so that the needle plate lock member 112 is urged rearward (toward the rotary needle plate 76) by the urging spring 114.

The engaging portion 112A of the needle plate lock member 112 is inserted into the lock groove 76A of the rotary needle plate 76 to be engaged with the lock groove 76A, and thereby the rotation of the rotary needle plate is locked (prevented) by the needle plate lock mechanism 110. Hereinafter, the position of the rotary needle plate 76 locked (prevented) by the needle plate lock mechanism 110 is referred to as a needle plate lock position.

Further, the lock state of the rotary needle plate 76 by the needle plate lock mechanism 110 is released by applying rotational force equal to or greater than a predetermined value to the rotary needle plate 76. That is, by applying the rotational force equal to or greater than the predetermined value to the rotary needle plate 76, the needle plate lock member 112 is moved forward against the urging force of the urging spring 114, and thereby the engaged state between the needle plate lock member 112 and the lock groove 76A is released. Then, the needle plate lock member 112 is engaged with the lock groove 76A again when the rotary needle plate 76 is rotated to the next needle plate lock position, and thereby the rotary needle plate 76 returns to the lock state by the needle plate lock mechanism 110. That is, the rotary needle plate 76 is configured to be locked at every predetermined rotation angle (22.5 degrees in the embodiment) by the needle plate lock mechanism 110. In other words, the rotation angle at which the rotation body 44 is locked by the lock mechanism 50 matches the rotation angle at which the rotary needle plate 76 is locked by the needle plate lock mechanism 110.

The position of the needle plate hole 72 with respect to the rotary needle plate 76 around the axis line AL is set such that the needle plate hole 72 and the cutwork blade 60 (blade portion 64) held at the blade-side rotation position are arranged to face each other in the up-down direction, at the needle plate lock position of the rotary needle plate 76. That is, by rotating the rotary needle plate 76 to the needle plate lock position according to the blade-side rotation position of the cutwork blade 60 (rotation body lock position of the rotation body 44), the needle plate hole 72 and the cutwork blade 60 (blade portion 64) are arranged to face each other in the up-down direction.

As described above, the needle plate hole 72 is configured to include the hole-side cutting surface 72A which extends in the radial direction of the rotation body 44, and the hole-side curved surface 72B which is curved to be convex to one side of the rotation direction of the rotation body 44. Therefore, by aligning the needle plate lock position of the rotary needle plate 76 and the rotation body lock position of the rotation body 44 such that the needle plate hole 72 and the cutwork blade 60 (blade portion 64) are arranged to face each other in the up-down direction, the blade portion 64 can be inserted into the needle plate hole 72 in a state where the direction of the blade portion 64 of the cutwork blade 60 matches the direction of the needle plate hole 72. Accordingly, similar to the first embodiment, the finish of the cut portion of the cutting target object 90 can be improved even in the second embodiment.

Further, in the second embodiment, the needle plate 70 is configured to include the rotary needle plate 76 and the needle plate body 74, and the rotary needle plate 76 is rotatably supported by the needle plate body 74. In addition, the rotary needle plate 76 is locked at every predetermined rotation angle to be held at the needle plate lock position by the needle plate lock mechanism 110. In this manner, even in a case where one needle plate hole 72 is formed in the needle plate 70, the blade portion 64 can be inserted into the needle plate hole 72 in a state where the direction of the blade portion 64 of the cutwork blade 60 matches the direction of the needle plate hole 72.

Third Embodiment

Figure 7:
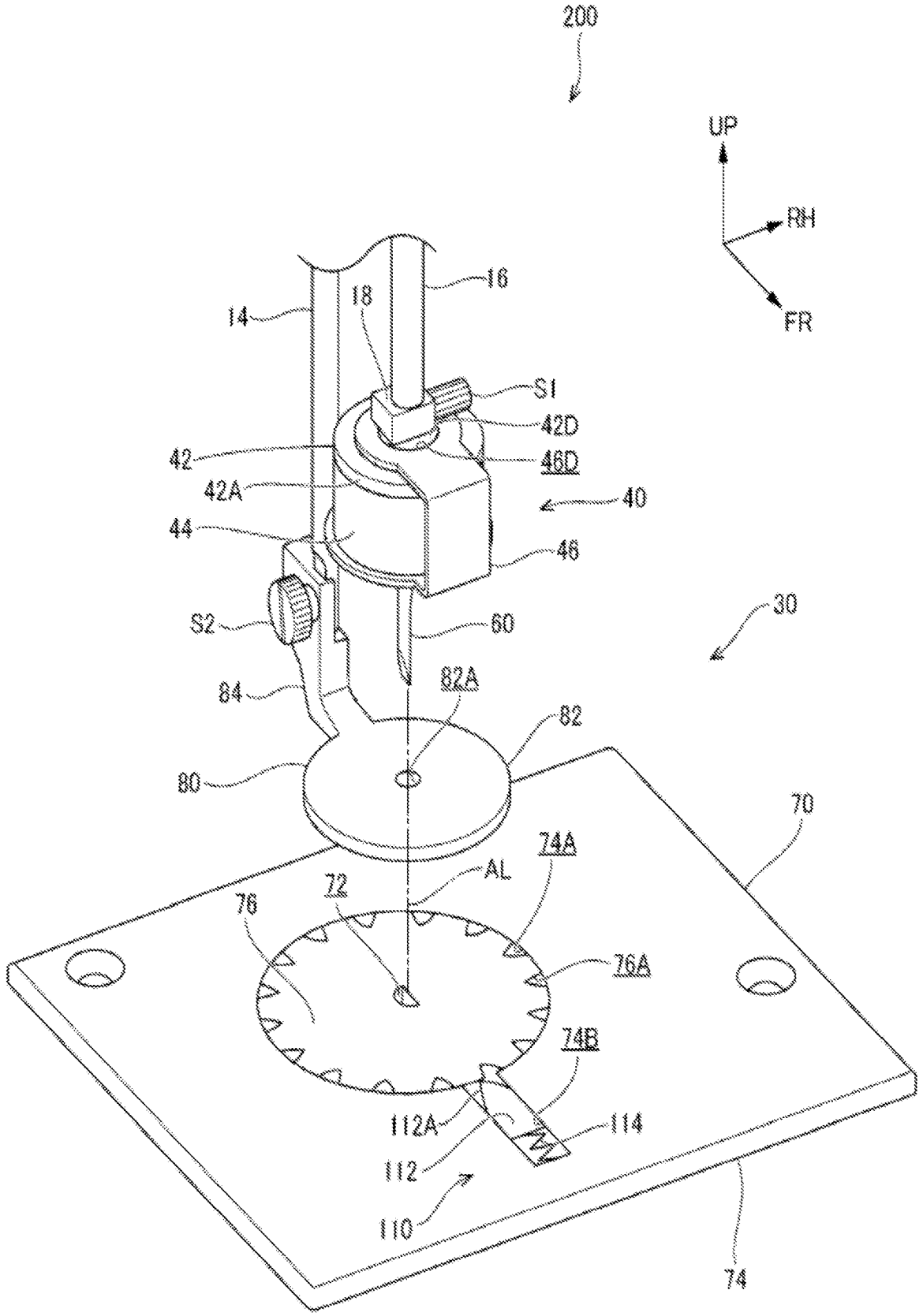
FIG. 7 is a perspective view illustrating a main part of a sewing machine according to a third embodiment, which is seen diagonally from the front left.

Hereinafter, a sewing machine 200 according to a third embodiment will be described using FIG. 7. The sewing machine 200 of the third embodiment is configured similar to the sewing machine 100 of the second embodiment except the following points. In FIG. 7, the portions configured similar to the sewing machine 100 are denoted by the same reference numerals.

That is, in the sewing machine 200 of the third embodiment, the cutwork blade 60 is fixed to the rotation body 44, at a position coaxial with the needle bar 16. That is, the fixing hole 44C of the rotation body 44 (not illustrated in FIG. 7) is formed at the central portion of the rotation body 44. In this manner, at each blade-side rotation position of the cutwork blade 60, the position of the blade portion 64 relative to the rotary needle plate 76 is not changed, but the direction of the blade portion 64 relative to the rotary needle plate 76 is changed.

In addition, in the third embodiment, the needle plate hole 72 is formed at the central portion of the rotary needle plate 76, corresponding to the position of the cutwork blade 60. That is, the needle plate hole 72 and the cutwork blade 60 (blade portion 64) are arranged to face each other in the up-down direction. Further, the position of the needle plate hole 72 with respect to the rotary needle plate 76 around the axis line AL is set such that the direction of the needle plate hole 72 at the needle plate lock position of the rotary needle plate 76 matches the direction of the blade portion 64 of the cutwork blade 60 at any of the blade-side rotation positions. That is, in the third embodiment, the directions of the blade portion 64 and the needle plate hole 72 match each other by rotating the rotary needle plate 76.

In this manner, by rotating the rotary needle plate 76 to the predetermined needle plate lock position such that the direction of the needle plate hole 72 and the direction of the blade portion 64 of the cutwork blade 60 match each other, the blade portion 64 can be inserted into the needle plate hole 72 in a state where the blade-side cutting surface 64A of the blade portion 64 and the hole-side cutting surface 72A of the needle plate hole 72 are arranged to face each other. Accordingly, similar to the first and second embodiments, the finish of the cut portion of the cutting target object 90 can be improved even in the third embodiment.

Further, in the third embodiment, the cutwork blade 60 is arranged coaxially with the needle bar 16. In this manner, pressing force applied from the needle bar 16 to the cutwork blade 60 when the cutting target object 90 is cut by the cutwork blade 60 can be efficiently applied to the cutting target object 90. In this manner, the finish of the cut portion of the cutting target object 90 can be further improved.

In the third embodiment, the insertion hole 82A of the presser 80 is formed at the central portion of the presser plate portion 82, corresponding to the position of the cutwork blade 60. In addition, the insertion hole 82A is formed in a circular shape into which the blade portion 64 of the cutwork blade 60 can be inserted.

Regarding Modification Example of Shapes of Blade Portion 64 of Cutwork Blade 60 and Needle Plate Hole 72

Figure 8A:
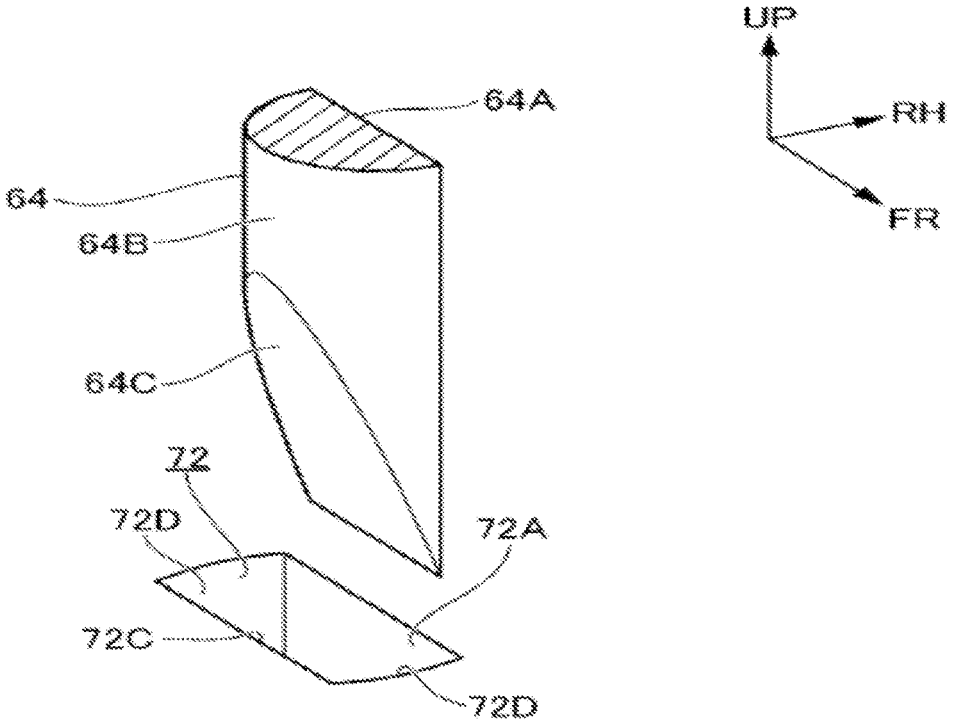
FIG. 8A is a perspective view illustrating a modification example of the needle plate hole illustrated in FIG. 3.

As illustrated in FIG. 8A, in Modification Example 1, the blade portion 64 of the cutwork blade 60 is formed in a shape similar to that in the first to third embodiments. On the other hand, the needle plate hole 72 is formed in a substantially track shape in a plan view. That is, the needle plate hole 72 is configured by the hole-side cutting surface 72A, a first inner circumferential surface 72C arranged parallel to the hole-side cutting surface 72A, and a pair of second inner circumferential surfaces 72D which are curved in an arc shape connecting the hole-side cutting surface 72A and the first inner circumferential surface 72C. Even in this case, when the blade portion 64 is inserted into the needle plate hole 72, the hole-side cutting surface 72A and the blade-side cutting surface 64A are arranged to face each other by matching the direction of the needle plate hole 72 with the direction of the blade portion 64, and thus the finish of the cut portion of the cutting target object 90 can be improved.

Figure 8B:
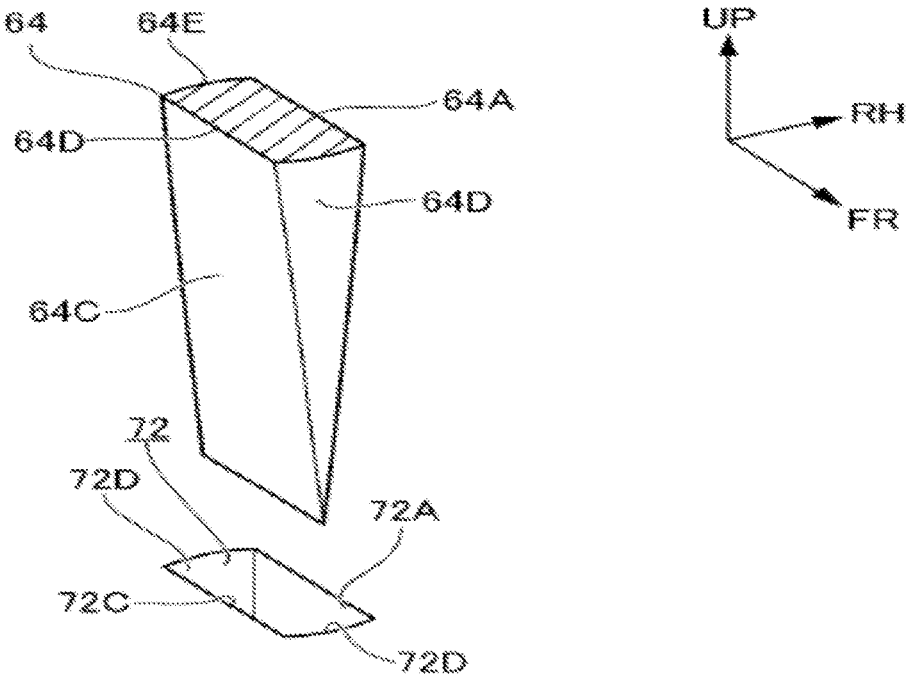
FIG. 8B is a perspective view illustrating another modification example of the blade portion of the cutwork blade and the needle plate hole illustrated in FIG. 3.

As illustrated in FIG. 8B, in Modification Example 2, the blade portion 64 of the cutwork blade 60 is formed to have a substantially track-shaped section. Specifically, the blade portion 64 is configured by the blade-side cutting surface 64A, a first outer circumferential surface 64D arranged parallel to the blade-side cutting surface 64A, and a pair of second outer circumferential surfaces 64E which are curved in an arc shape connecting the blade-side cutting surface 64A and the first outer circumferential surface 64D. The needle plate hole 72 in Modification Example 2 is formed in a substantially track shape in a plan view, similar to the needle plate hole 72 in Modification Example 1. That is, the needle plate hole 72 is configured by the hole-side cutting surface 72A, the first inner circumferential surface 72C arranged parallel to the hole-side cutting surface 72A, and the pair of second inner circumferential surfaces 72D which are curved in an arc shape connecting the hole-side cutting surface 72A and the first inner circumferential surface 72C. Even in this case, when the blade portion 64 is inserted into the needle plate hole 72, the hole-side cutting surface 72A and the blade-side cutting surface 64A are arranged to face each other by matching the direction of the needle plate hole 72 with the direction of the blade portion 64, and thus the finish of the cut portion of the cutting target object 90 can be improved.

The first to third embodiments can be variously omitted, replaced, and changed without departing from the scope of the invention, and the modifications thereof are also included in the invention.

What is claimed is:

1. A sewing machine comprising:

a rotation mechanism configured to include a base attached to a lower end portion of a needle bar that is moved up and down, and a rotation body connected to the base to be rotatable around an axis of the needle bar;

a cutwork blade which is provided on the rotation body, and extends downward from the rotation body; and a needle plate which is provided below the rotation mechanism, and has a needle plate hole for cutting a cutting target object in cooperation with a blade portion of the cutwork blade when the blade portion is inserted into the needle plate hole, wherein:

the blade portion of the cutwork blade has a blade-side cutting surface, and the needle plate hole has a hole-side cutting surface corresponding to the blade-side cutting surface:

an axis line of the cutwork blade moves along a rotating direction of the rotation body with respect to the needle plate hole; and the blade portion is inserted into the needle plate hole in a state where the hole-side cutting surface of the needle plate hole fits the blade-side cutting surface of the blade portion of the cutwork blade.

2. The sewing machine according to claim 1, wherein the rotation body is locked at a predetermined rotation angle by a lock mechanism, the cutwork blade is arranged at a position apart from an axis line of the needle bar, and a plurality of needle plate holes are formed around the axis line of the needle bar at the same angle as the predetermined angle of the lock mechanism, on a reference circle having, as a radius, the same distance as a distance between the axis line of the needle bar and the cutwork blade.

3. The sewing machine according to claim 1, wherein the rotation body is locked at a predetermined rotation angle by a lock mechanism, and the needle plate is configured to include a needle plate body fixed to the sewing machine body, and a rotary needle plate which is connected to the needle plate body to be rotatable around the axis of the needle bar, and is able to be locked at every angle that is the same as the predetermined angle of the lock mechanism, and in which the needle plate hole is formed.

4. The sewing machine according to claim 3, wherein the cutwork blade is arranged coaxially with the needle bar.

5. The sewing machine according to claim 3, wherein the cutwork blade and the needle plate hole are arranged at positions apart from an axis line of the needle bar by the same distance.

6. The sewing machine according to claim 1, wherein the blade-side cutting surface of the blade portion is linearly formed when seen from an axial direction of the needle bar, and the hole-side cutting surface of the needle plate hole is formed in a flat surface shape.

* * * * *